US005516201A

United States Patent [19]

Rotceig

[11] Patent Number: 5,516,201

[45] Date of Patent: May 14, 1996

[54] ROTARY SUPPORT APPARATUS

[76] Inventor: Marc Rotceig, 26, rue de Linois, F-75015 Paris, France

[21] Appl. No.: 256,729

[22] PCT Filed: Feb. 25, 1993

[86] PCT No.: PCT/FR93/00185

§ 371 Date: Jul. 21, 1994

§ 102(e) Date: Jul. 21, 1994

[87] PCT Pub. No.: WO93/17599

PCT Pub. Date: Sep. 16, 1993

[30] Foreign Application Priority Data

Mar. 2, 1992 [FR] France ..... 92 02465

[51] Int. Cl.[6] ..... A47B 49/00

[52] U.S. Cl. ..... 312/268; 312/307; 312/134

[58] Field of Search ..... 312/307, 134, 312/268, 304; 414/331, 679

[56] References Cited

U.S. PATENT DOCUMENTS

| | | | |
|---|---|---|---|
| 2,315,790 | 4/1943 | Hallwood | 312/134 |
| 3,199,658 | 8/1965 | Graber et al. | 312/268 X |
| 4,017,132 | 4/1977 | Banys | 312/268 |
| 4,178,048 | 12/1979 | Zippel | 312/268 X |
| 4,793,666 | 12/1988 | Torrence | 312/134 |

FOREIGN PATENT DOCUMENTS

| | | | |
|---|---|---|---|
| 114671 | 8/1984 | European Pat. Off. | 312/134 |
| 1167311 | 4/1964 | Germany | 312/268 |
| 2823541 | 12/1979 | Germany | 312/268 |
| 592315 | of 1959 | Italy | 312/268 |
| 6403637 | 12/1964 | Netherlands | 312/268 |

*Primary Examiner*—Peter M. Cuomo
*Assistant Examiner*—Janet M. Wilkins
*Attorney, Agent, or Firm*—Young & Thompson

[57] ABSTRACT

A device with a concealed mechanism and visible shelves is arranged on two vertical planes (1 and 2), one in front of the other, parallel to the rear of the shelves. The rear plane (1) supports the mechanism while the front plane (2) serves to support the shelves mounted on rotary supports (14). The shelves are horizontally supported by two distinct and symmetrical slides in which run rollers carrying the shelf supports.

8 Claims, 2 Drawing Sheets

ROTARY SUPPORT APPARATUS

FIELD OF THE INVENTION

The present invention relates to apparatus with rotary supports for shelves.

BACKGROUND OF THE INVENTION

In apparatus of this type, the shelves are superposed in two columns, disposed in front and to the rear, the first column masking the second.

The shelves are fixed to the mechanism at each of their lateral sides. There are therefore two identical mechanisms, connected by a motor shaft which passes through the apparatus.

On the other hand, the shelves are maintained horizontal by a lever bearing a roller engaged in a slideway, for each of the mechanisms. There are thus two slideways face to face.

SUMMARY OF THE INVENTION

The device according to the invention permits positioning these two columns of shelves side by side, such that all the shelves are visible at once.

To this end, the device according to the invention comprises, according to a first characteristic, two vertical parallel planes, disposed one in front of the other, between which is interposed the mechanism which is fixed in the rear plane.

The forward plane, on which bear the shelves, has an endless slot in the form of an elongated loop through which pass the axes of the supports on which the shelves are fixed at their rear. The portion which defines this slot being maintained in place by any securement means which project on the rear plane; this latter could also be constituted by the wall of a chamber or the divider of the furniture on which the apparatus is fixed.

The mechanism is of the type described in French patent 8801976 and its addition 8901963; but the support plates of cast metal which it comprises have, according to another characteristic, four semi-circular ribs, concentric two by two, which constitute the arcuate portion of the two slideways. The projection, which supports the chain pinions, is formed in the middle of four downstrokes of these arcs of circles.

According to another characteristic, the shelf supports bear two rollers, engaged respectively in each of the two slide guides; these rollers therefore follow parallel paths and always remain disposed, the one with respect to the other, in the same horizontal line.

According to still another characteristic, the arms of the shelf supports carry, on one of their surfaces, a roller which bears on the two vertical planes of the device which thus retains the shelf supports when the latter, loaded, tend to be driven forwardly.

BRIEF DESCRIPTION OF THE DRAWINGS

The accompanying drawings illustrate the invention.

DETAILED DESCRIPTION OF THE INVENTION

Figure 1:
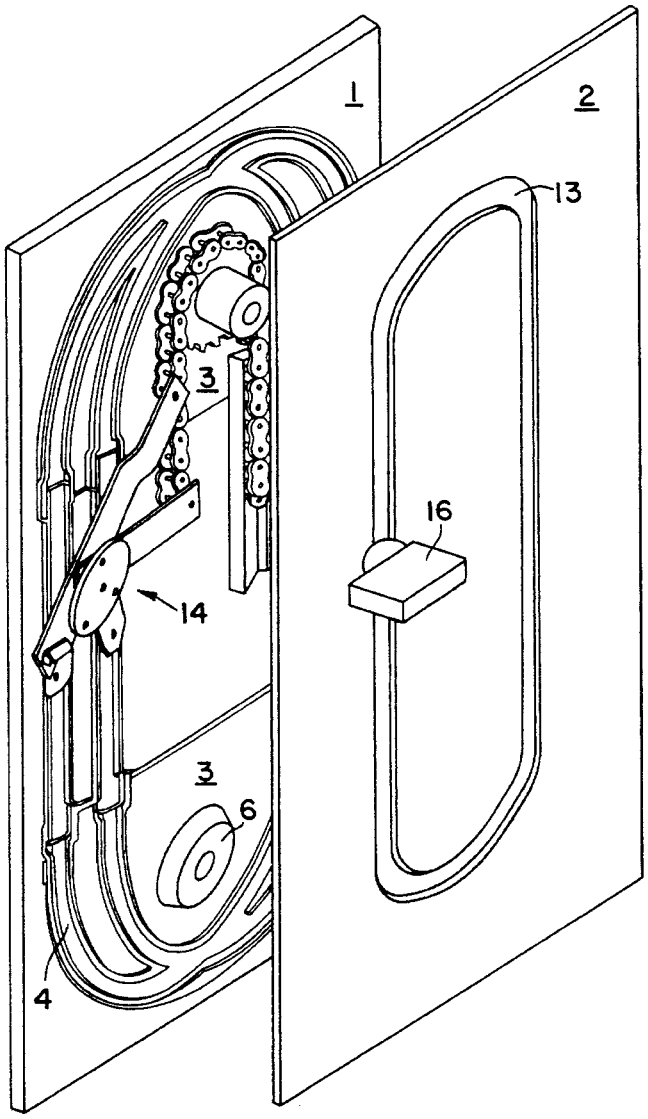
FIG. 1 shows in perspective the arrangement of the two planes of the device.
Figure 2:
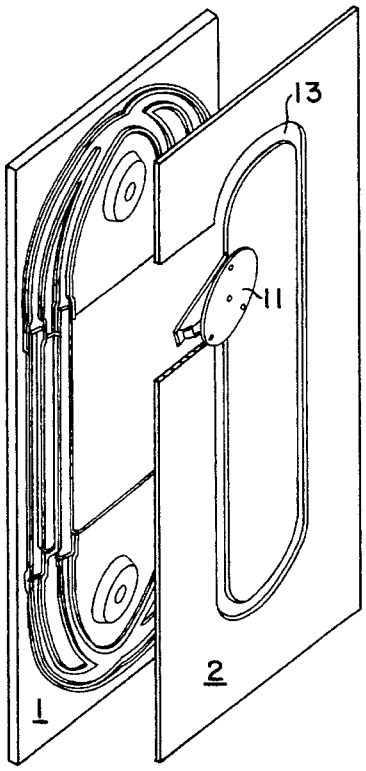
FIG. 2 shows the same view, the axle of the rotary support of the shelf passing through the slot.
Figure 3:
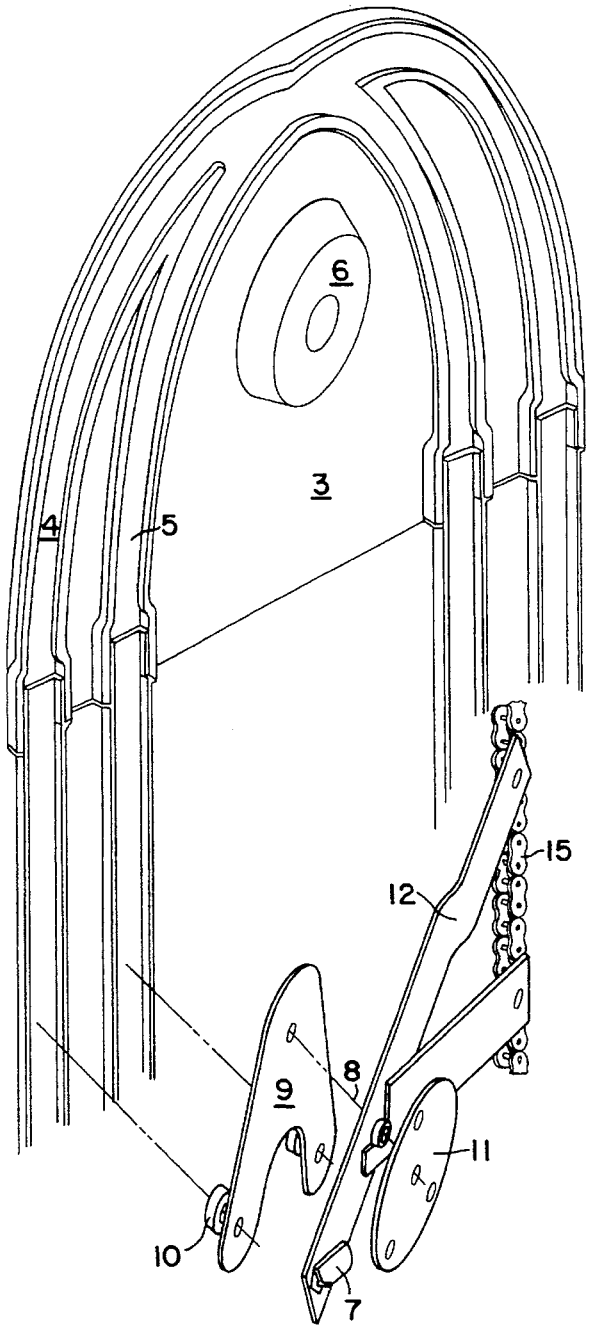
FIG. 3 shows in perspective the support plate of cast metal and, in exploded view, the rotary shelf support.
Figure 4:
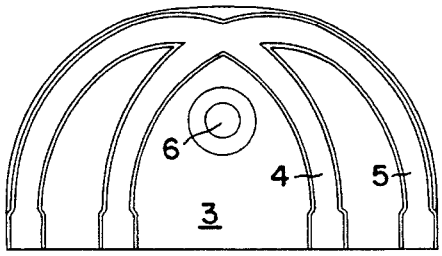
FIG. 4 shows the support plate of cast metal in a frontal view.

Referring to these drawings, the device is arranged in two vertical parallel planes, disposed one in front of the other. The rear plane 1 carries the mechanism which is interposed between the two vertical planes. The forward plane 2 has an endless slot 13 forming an elongated loop through which pass the axles 8 of the rotatable shelf supporting mechanisms 14 (only one being shown in the drawings).

The mechanism comprises, from top to bottom, the cast metal plates 3 of the type described in French patent 8801976; therefore, whose shape here has, according to a second characteristic, four semi-circular ribs, concentric two by two, constituting the slideways 4 and 5 in arcs of circles.

The straight portions connecting the slideways of the support plate 3 at the top to that at the bottom, constitute the two slideways 4 and 5, in the shape of closed loops, separate from each other and symmetrical and disposed in the same vertical plane. A projection 6 disposed in the middle of the slideways supports a sprocket wheel and a chain 15 in a manner similar to French Patent 8801976.

The shelf supporting mechanism 14 comprises two carrying arms 12 which are mounted by one of their ends on the chain 15 and are connected by the other of their ends via an axle 8 which passes through them. This axle 8 bears in front a plate 11, on which is fixed the cantilevered shelf 16; and to the rear, a member 9 of V shape, whose two legs carry a roller 10. These two rollers 10, engaged respectively in each of the slide guides 4 and 5, are thus caused to follow parallel paths and remain positioned, one relative to the other, on a same horizontal line. The V-shaped member 9, the axle 8 and the plate 11 forming a solid block, the shelf 16 fixed on the plate 11 is therefore maintained horizontal.

According to still another characteristic, a roller 7 fixed on the surface of arm 12 which faces the back of the plane 2, comes to bear against this plane and thereby maintains the shelf support 14 which is driven forwardly by the weight that it carries.

I claim:

1. Apparatus with rotary support for shelves the apparatus comprising:

a front member and an opposite parallel rear member;

a rotary mechanism fixed against said rear member;

an endless slot extending through said front member;

at least one shelf supporting mechanism operatively associated with said rotary mechanism; at least one cantilevered shelf mounted at its rear on said at least one shelf supporting mechanism; said front member serving as a bearing surface for said at least one shelf, whereby a rear surface of said at least one shelf always lies in a common plane which is substantially parallel to said front member, and said at least one shelf is always visible.

2. The apparatus according to claim 1, wherein the rotary mechanism includes two slideways forming closed loops disposed on a surface of said rear member.

3. The apparatus according to claim 2, wherein the rotary mechanism further includes a first sprocket and an opposite second sprocket positioned within said closed loops, said first sprocket adjacent a first end of said closed loops and said second sprocket adjacent an opposite second end of said closed loops.

4. The apparatus according to claim 3, wherein the rotary mechanism further includes an endless chain extending between and engaging said first sprocket and said second sprocket.

5. The apparatus according to claim 2, wherein said at least one shelf supporting mechanism includes an axle extending between and fixed to a V-shaped member and a shelf-supporting plate, said axle extending through said endless slot, said front member being disposed between said V-shaped member and said plate.

6. The apparatus according to claim 5, wherein the V-shaped member includes a first leg and a second leg, each leg having a roller attached thereto, and each roller being disposed within a respective slideway.

7. Apparatus with rotary support for shelves comprising:

a front member and an opposite rear member;

two slideways forming closed loops disposed on a surface of said rear member;

an endless slot extending through said front member;

a first sprocket and an opposite second sprocket positioned within said closed loops, said first sprocket adjacent a first end of said closed loops and said second sprocket adjacent an opposite second end of said closed loops;

an endless chain extending between and engaging said first sprocket and said second sprocket;

an axle extending between and fixed to a V-shaped member and a shelf-supporting plate, said axle extending through said endless slot, said front member being disposed between said V-shaped member and said plate, a first leg and a second leg of said V-shaped member each having a roller attached thereto, each of said roller being disposed within their respective slideway; and a first and second carrying arm each having a first portion, which is attached to said endless chain, and an opposite second portion, said axle extending between said opposite second portion of said first and said second carrying arm to connect said first and second carrying arms together, said first and second carrying arms being disposed between said front and said rear member.

8. The apparatus according to claim 7, further comprising a roller fixed on the surface of said first carrying arm.

* * * * *